US010770867B2

(12) United States Patent
Klinger et al.

(10) Patent No.: US 10,770,867 B2
(45) Date of Patent: Sep. 8, 2020

(54) ARRESTER

(71) Applicant: TDK Electronics AG, Munich (DE)

(72) Inventors: Torsten Klinger, Berlin (DE); Zhipeng Fang, Xiaogan (CN); Frank Werner, Berlin (DE)

(73) Assignee: TDK Electronics AG, Munich (DE)

( * ) Notice: Subject to any disclaimer, the term of this patent is extended or adjusted under 35 U.S.C. 154(b) by 0 days.

(21) Appl. No.: 16/626,470

(22) PCT Filed: Jun. 26, 2018

(86) PCT No.: PCT/EP2018/067129
§ 371 (c)(1),
(2) Date: Dec. 24, 2019

(87) PCT Pub. No.: WO2019/007755
PCT Pub. Date: Jan. 10, 2019

(65) Prior Publication Data

US 2020/0185887 A1 Jun. 11, 2020

(30) Foreign Application Priority Data

Jul. 5, 2017 (DE) ..... 10 2017 115 035

(51) Int. Cl.
*H01T 4/12* (2006.01)
*H01T 1/20* (2006.01)

(52) U.S. Cl.
CPC *H01T 4/12* (2013.01); *H01T 1/20* (2013.01)

(58) Field of Classification Search
CPC .... H01T 4/12; H01T 1/20; H01T 4/02; H01T 4/10
See application file for complete search history.

(56) References Cited

U.S. PATENT DOCUMENTS

| | | | | |
|---|---|---|---|---|
| 3,818,259 | A | 6/1974 | Schleimann-Jensen | |
| 4,104,693 | A | 8/1978 | Toda et al. | |
| 7,643,265 | B2 * | 1/2010 | Loader | H01T 1/14 361/112 |
| 7,932,673 | B2 | 4/2011 | Schleimann-Jensen et al. | |
| 8,080,927 | B2 | 12/2011 | Boy et al. | |
| 9,190,811 | B2 | 11/2015 | Soelter | |
| 2016/0190771 | A1 | 6/2016 | Werner et al. | |

FOREIGN PATENT DOCUMENTS

| | | | |
|---|---|---|---|
| DE | 2310960 | A | 9/1973 |
| DE | 102008029094 | A1 | 1/2009 |
| DE | 102011014582 | A1 | 9/2012 |
| DE | 102013109393 | A1 | 3/2015 |
| EP | 2648292 | A2 | 10/2013 |
| EP | 2648293 | A2 | 10/2013 |
| JP | H06140122 | A | 5/1994 |
| JP | 2004127832 | A | 4/2004 |

* cited by examiner

*Primary Examiner* — Joseph L Williams
(74) *Attorney, Agent, or Firm* — Slater & Matsil, LLP

(57) ABSTRACT

An arrester is disclosed. In an embodiment an arrester includes at least one first and one second electrode, a ceramic body for electrical isolation of the electrodes, wherein the electrodes are spaced by a distance from one another in a direction of a transverse axis of the arrester, and wherein the distance between the electrodes varies along a longitudinal axis of the arrester.

19 Claims, 2 Drawing Sheets

ARRESTER

This patent application is a national phase filing under section 371 of PCT/EP2018/067129, filed Jun. 26, 2018, which claims the priority of German patent application 102017115035.8, filed Jul. 5, 2017, each of which is incorporated herein by reference in its entirety.

TECHNICAL FIELD

The invention relates to an arrester for providing protection against overvoltages, in particular a gas discharge surge arrester.

BACKGROUND

Gas-filled arresters, also known as gas arresters, are arresters in which the overvoltage is reduced in the gas arrester by automatic ignition of a gas discharge. They operate by the arc discharge principle, a principle determined by the physical properties of gases, wherein once an arrester sparkover voltage, also known as a sparkover voltage or triggering voltage, is reached, an arc forms in the gas-tight discharge chamber within nanoseconds. The high current-carrying capacity of the arc effectively short-circuits the overvoltage.

If an arrester is activated during surge current loading, charge carriers, in general electrons, of the cathode strike the anode, which on the one hand represents heavy loading for the anode material. It is also clear that the electrical properties of arresters, in particular insulation resistance after surge current loading, are impaired with an increasing number of instances of activation. In conventional gas arresters with two electrodes, it is in particular possible for conductive electrode material to be vapor-deposited on the ceramic internal wall. This leads to a reduction in the insulation resistance of the arrester. It may additionally lead to inadmissibly high leakage currents during operation at nominal AC voltages.

European Patent Application Nos. EP 2 648 292 A2 and EP 2 648 293 A2 describe a gas-filled discharge tube in which the ceramic material used has a special shape, whereby large-area vapor deposition on the ceramic material is prevented and insulation resistance after loading is increased.

SUMMARY OF THE INVENTION

Embodiments provide an improved arrester, for example, an arrester which is particularly compact and/or has a very high surge current carrying capacity and/or high insulation resistance.

According to one embodiment, an arrester is provided. The arrester is configured to provide overvoltage protection. For example, the arrester serves to provide protection against overvoltages in applications in the telecommunications sector. Preferably, the arrester can be used over a range up to a 20 kA current loading and an 8/20 μs pulse wave.

The arrester has a first electrode. The arrester additionally has a second electrode. The arrester may also have further electrodes, for example a third electrode. The electrodes comprise an electrically conductive material, for example copper or an iron-nickel alloy.

The arrester further has a main body, in particular a ceramic body. The ceramic body is configured and arranged for electrical isolation of the electrodes. The ceramic body further serves in mechanical connection of the electrodes.

The ceramic body has a simple basic shape, for example a cylindrical shape or an annular shape.

The electrodes and the ceramic body enclose a cavity filled with a noble gas. The arrester is preferably a gas discharge surge arrester.

The electrodes are spaced by a distance A from one another in the direction of a transverse axis of the arrester. The distance A between the electrodes varies along a longitudinal axis of the arrester. The longitudinal axis in this case extends perpendicular to the transverse axis.

A shape or external form of the electrodes is simply adaptable to the special requirements of the arrester. The special shaping of the electrodes prevents large-area vapor deposition on the ceramic body. In this way, it is ensured that the arrester exhibits high insulation resistance after loading.

The ceramic material may be kept very simple with regard to shaping. In particular, no special shaping of the ceramic material is needed to increase insulation resistance. High manufacturing costs for a complex ceramic material are dispensed with.

The electrodes may moreover be kept narrow or shallow. For example, the basic shape of the electrodes is disc- or plate-like. This enables a small structural height to be achieved for the arrester. A space-saving, inexpensive and particularly effective arrester is thereby provided.

According to one exemplary embodiment, the respective electrode has at least one recess. The recess constitutes a central recess. In particular, the recess is formed in a central or middle region of the respective electrode and thus in a central region of the arrester. The recess may be understood to be a bulge.

Preferably, the arrester is of rotationally symmetrical configuration. The recesses of the electrodes are formed mutually opposite around the longitudinal axis of the arrester. The recesses are preferably formed by a punching process.

The respective recess enlarges the extent of the cavity along the transverse axis. The recesses increase the distance A between the electrodes (distance between the electrodes in a transverse direction of the arrester). In particular, the distance between the electrodes is at its maximum in the region of the recesses.

According to one exemplary embodiment, the arrester has at least one arc ignition region. The arrester may also have more than one arc ignition region, for example two arc ignition regions. The arrester moreover has at least one arc burning region. An activation material is preferably arranged in the arc burning region. The activation material, for example silicates and/or halides of alkali metals, spatially determines the region in which the arc burns.

The arc ignition region and arc burning region are spatially separated from one another. The arc burning region is preferably arranged in a region between the recesses. The distance between the electrodes is consequently at its maximum in the arc burning region and in particular greater than the distance of the electrodes in the arc ignition region. In addition, the arc burning region is preferably arranged in a central or middle region of the arrester. The at least one arc ignition region adjoins the arc burning region and is preferably arranged in a lateral region of the arrester. The arc ignition region is thus placed spatially closer to the ceramic body than the arc burning region.

On activation of the arrester, anode material may dissolve out of the anode. This dissolved-out anode material may be deposited on the ceramic body, which electrically isolates the two electrodes. An electrical bridge, i.e. a galvanic connection with increasingly lower electrical resistance, is thus formed between the two electrodes as the instances of activation increase, so reducing insulation resistance.

Because the arrester is subdivided into two different regions and in particular the arc ignition region is spatially separated from the arc burning region, charge transfer is focused in the centrally placed arc burning region. In this way, the ceramic body is protected against conductive particles of the anode being vapor-deposited thereon. Although anode material may additionally be distributed in the interior of the arrester, the separation of arc burning region and arc ignition region means that substantially only surfaces in the central burning region, i.e. substantially the electrodes themselves, will suffer vapor deposition. The ceramic body is thereby not short-circuited and the insulation resistance of the arrester may also operate reliably after a high number of instances of surge current loading. A particularly reliable and durable arrester is thus provided.

According to one exemplary embodiment, the respective electrode has a sequence of at least one recess and at least one raised portion or convexity. The specific shape of the respective electrode prevents large-area vapor deposition on the ceramic body and thus ensures high insulation resistance after loading.

According to one exemplary embodiment, the arrester has a third electrode. The third electrode is arranged between the first and second electrodes. The third electrode has a simple and in particular a straight shape. The third electrode has a planar surface. In particular, the third electrode does not have a recess. The third electrode is thus of a distinctly simpler configuration than the first and second electrodes.

The third electrode may have an opening or a cut-out. The opening serves in connecting the gas-filled cavity between the first and third electrodes with the gas-filled cavity between the second and third electrodes. In this way, both portions of the arrester may be ignited in the case of overvoltage.

The first and second electrodes exhibit a minimum distance A from one another in the direction of the transverse axis of the arrester. In addition to the region of maximum distance, there is consequently a region in which the distance between the electrodes is at a minimum. The first and second electrodes preferably each have at least one convexity. The convexity comprises an annular groove, for example. The respective convexity is punched, for example. The convexity extends along the transverse axis of the arrester into the respective gas-filled cavity. The minimum distance is formed in the region of the convexity.

Alternatively or in addition, the first and third electrodes exhibit a minimum distance from one another in the direction of the transverse axis of the arrester. The first electrode preferably has a convexity or raised portion in the region of minimum distance. The third electrode preferably does not have a raised portion or convexity.

Alternatively or in addition, the second and third electrodes exhibit a minimum distance from one another in the direction of the transverse axis of the arrester. The second electrode preferably has a convexity or raised portion in the region of minimum distance.

The at least one arc ignition region may be arranged in the region of minimum distance. The minimum distance between the electrodes simplifies ignition of the arc. A particularly effective arrester is thus provided.

According to one exemplary embodiment, the respective central recess has a diameter D1. The electrodes additionally have an internal diameter D2. The electrode internal diameter D2 here denotes an internal region of the respective electrode which is delimited laterally by the ceramic body. The electrode internal diameter D2 is characterized by the extent of the respective electrode in the region of the gas-filled cavity. Preferably, the following applies: $0.7 \leq (D2/D1) \cdot A \leq 1.3$. Particularly preferably, the following applies: $(D2/D1) \cdot A = 1.1$.

BRIEF DESCRIPTION OF THE DRAWINGS

The invention is explained in greater detail below on the basis of exemplary embodiments and the associated figures.

The drawings described below should not be considered true to scale. Rather, to provide an improved representation, individual dimensions may have been enlarged, reduced in size or indeed distorted.

Elements which are identical to one another or which assume the same function are denoted with the same reference signs.

Figure 1:
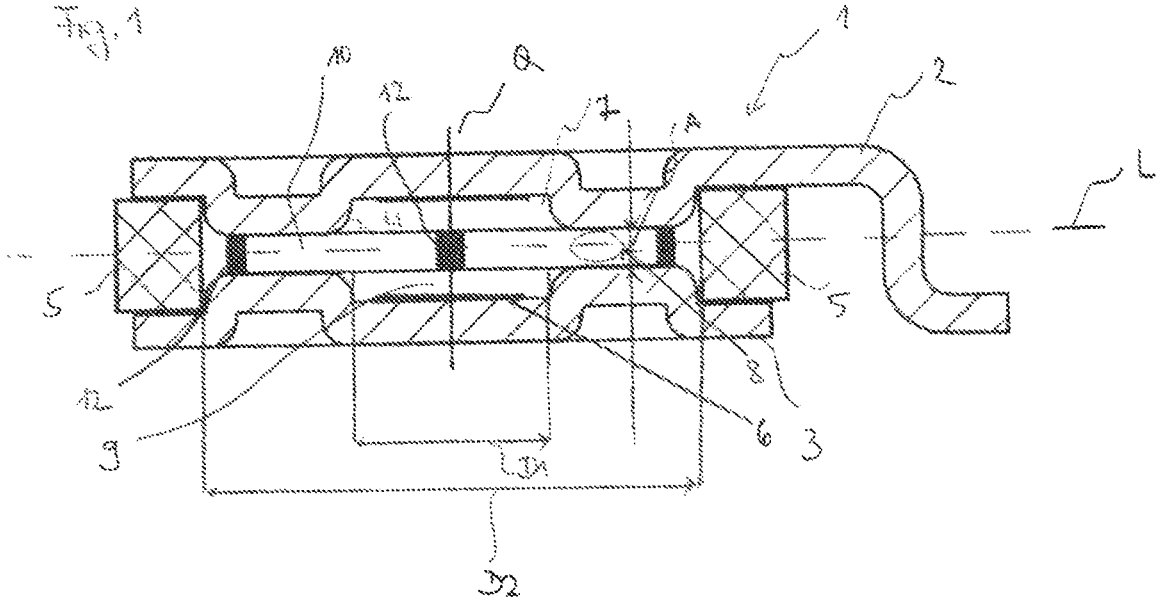
Figure 2:
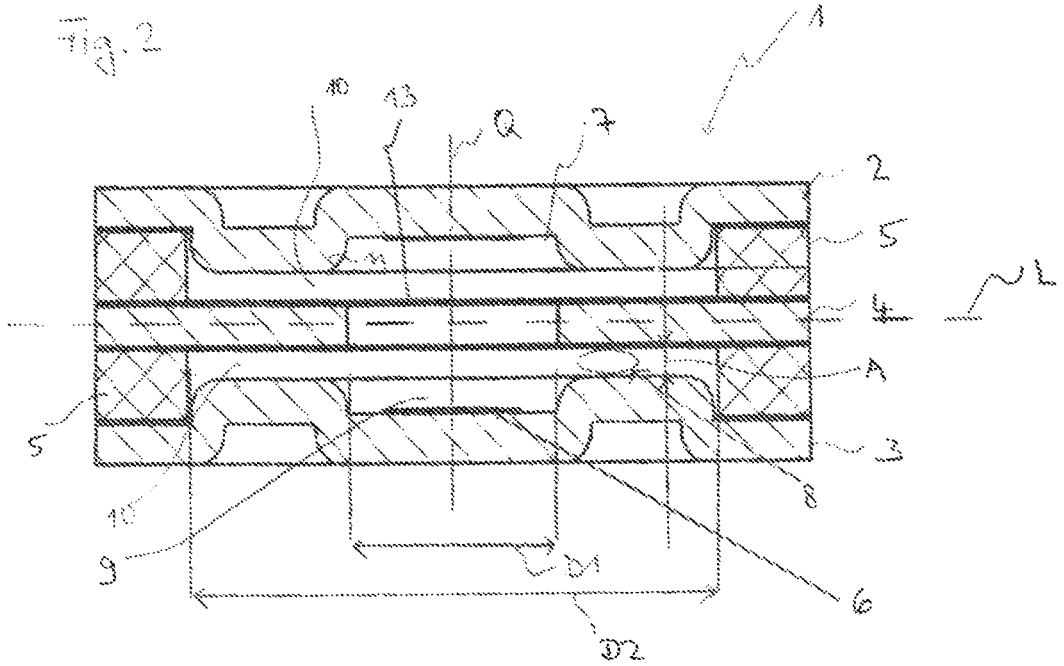
Figure 3:
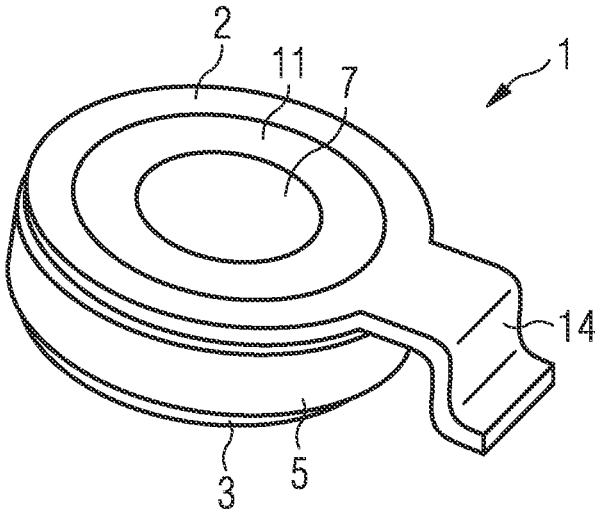
Figure 4:
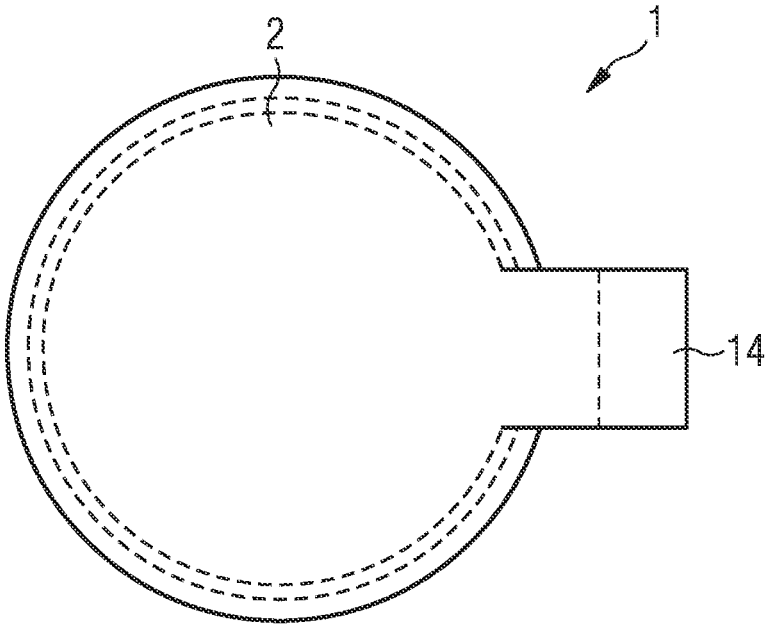

FIG. 1 shows a sectional representation of a two-electrode arrester for protection against overvoltages;

FIG. 2 shows a sectional representation of a three-electrode arrester for protection against overvoltages;

FIG. 3 shows a perspective view of the two-electrode arrester according to FIG. 1; and FIG. 4 shows a plan view onto the two-electrode arrester according to FIG. 1.

DETAILED DESCRIPTION OF ILLUSTRATIVE EMBODIMENTS

FIGS. 1, 3 and 4 show a two-electrode arrester 1 for protection against overvoltages. The arrester 1 has a first electrode 2 and a second electrode 3. The arrester 1 additionally has a ceramic body 5 for electrical insulation of the electrodes 2, 3. The ceramic body 5 additionally serves in mechanical connection of the electrodes 2, 3. The ceramic body 5 has a very simple shape, for example an annular shape or a cylindrical shape, as is apparent for example from FIG. 3.

The arrester 1 has a cavity 10 (FIG. 1). The cavity 10 is filled with a gas, in particular a noble gas. The arrester 1 is in particular a gas-filled surge arrester. The cavity 10 is delimited spatially in the direction of a transverse axis Q of the arrester 1 by the two electrodes 2, 3. The two electrodes 2, 3 thus form upper and lower boundaries for the cavity 10. In the direction of a longitudinal axis L of the arrester 1 the cavity 10 is spatially delimited by the ceramic body 5. The ceramic body 5 thus constitutes a lateral boundary for the cavity 10. An ignition aid 12 may be arranged in the cavity 10. The ignition aid 12 comprises, for example, lines (ignition lines) applied to the internal wall of the ceramic body 5 using a graphite pencil.

The cavity 10 has a diameter or a (maximum) extent along the longitudinal axis L. The diameter of the cavity 1 corresponds to an electrode internal diameter D2 of the respective electrode 2, 3. The electrode internal diameter D2 here denotes an internal region of the respective electrode 2, 3 which is delimited laterally by the ceramic body 5. The electrode internal diameter D2 is characterized by the extent of the respective electrode 2, 3 in the region of the cavity 10.

The electrodes 2, 3 comprise an electrically conductive material. The respective electrode 2, 3 may for example comprise copper or an iron-nickel alloy. The material of the respective electrode 2, 3 is preferably plastically deformable. In a basic shape, the electrodes 2, 3 are preferably disc- or plate-like in configuration. In particular, the respective electrode 2, 3 is of shallow configuration. In other words, the respective electrode 2, 3 has a small extent along the transverse axis Q. In particular, a longitudinal extent of the respective electrode 2, 3 (i.e. an extent of the electrode 2, 3 along the longitudinal axis L) amounts to a multiple of the transverse extent.

The respective electrode 2, 3 has a curved shape. A surface of the respective electrode 2, 3 is uneven. In particular, the surface of the respective electrode facing the cavity and the surface remote from the cavity are uneven, i.e. these surfaces at least do not extend continuously along a longitudinal axis. In this case, the respective electrode 2, 3 may have a rounded or angular surface. For example, the respective electrode 2, 3 comprises a curved and/or punched metal strip or a curved and/or punched metal plate.

The electrodes 2, 3 exhibit a distance A from one another. In particular, A denotes the distance between the electrodes 2, 3 along the transverse axis Q. As a result of the special shaping of the electrodes 2, 3, the distance A varies along the longitudinal axis L, in other words, at different points along the longitudinal axis L the distances between the electrodes 2, 3 are different, as will be described in detail below.

The two electrodes 2, 3 may be formed symmetrically around the longitudinal axis L and/or around the transverse axis Q. In this exemplary embodiment, however, the first electrode 2 exhibits a greater extent 14 along the longitudinal axis L than the second electrode 3. The extent 14 takes the form of a strip. The extent 14 is curved in shape. The greater longitudinal extent 14 may enable or simplify electrical contacting of the arrester 1. In particular, the extent 14 serves in contacting of the first electrode 2 for example on an SMD pad.

Each electrode 2, 3 has a recess 7. In the sectional representation shown in FIG. 1, it is apparent that the recess 7 may be regarded as a bulge in the respective electrode 2, 3. In this case, at one surface, in particular the surface of the electrode 2, 3 facing the cavity 10, the recess 7 is apparent in the direction of the transverse axis Q, while at the surface (outer face) of the electrode 2, 3 remote from the cavity 10 a convexity/raised portion is present. The recess 7 is preferably of circular configuration (see FIG. 3).

The recess 7 of the two electrodes 2, 3 is in each case configured centrally around the longitudinal axis L of the arrester 1. The recess 7 is open towards the cavity 10. Since the respective recess 7 is arranged centrally in or in the middle of the gas-filled cavity 10 of the arrester 1, the respective recess 7 constitutes a central recess 7. The recesses 7 of the two electrodes 2, 3 are arranged in mutually opposing manner.

The recess 7 enlarges the distance A between the two electrodes 2, 3 in the direction across the longitudinal axis L, i.e. in the direction of the transverse axis Q. In other words, the recess 7 enlarges the extent of the cavity 10 along the transverse axis in a spatially delimited region. In particular, the electrodes 2, 3 have a maximum distance A in the region of the recesses 7.

Each electrode 2, 3 additionally has at least one convexity 11. It goes without saying that a plurality of convexities 11, for example two, three, four or five convexities 11, may also be provided.

In the sectional representation shown in FIG. 1, it is apparent that the convexity 11 may likewise be regarded as a bulge in the respective electrode 2, 3. Here, however, the direction of convexity is the opposite of the direction of convexity of the above-described recess 7. At the surface, facing the cavity 10, of the electrode 2, 3, the convexity 11/raised portion in the direction of the transverse axis Q is particularly apparent, while at the surface (outer face), remote from the cavity 10, of the respective electrode 2, 3 a recess is present.

The convexity 11 is of annular configuration (FIG. 3). The convexity 11 comprises an annular groove. The convexity 11 is punched into the respective electrode 2, 3, for example. This punching process at the same time produces the above-described recess 7.

The convexity 11 of the respective electrode 2, 3 frames the recess 7. In other words, in the direction of the longitudinal axis L the recess 7 of the respective electrode 2, 3 is delimited in all directions by the convexity 11. The respective convexity 11 is formed in a peripheral region of the cavity 10. In particular, the respective convexity 11 is configured to be less central than the recess 7.

The convexities 11 of the two electrodes 2, 3 are arranged in mutually opposing manner. The respective convexity 11 projects into the cavity 10. Consequently, the respective convexity 11 extends along the transverse axis Q in the direction of a central region of the arrester 1. The respective convexity 11 reduces the distance A between the two electrodes 2, 3 in the direction of the transverse axis Q. In other words, the convexities 11 reduce the extent of the cavity 10 along the transverse axis Q in a spatially delimited region. The convexities 11 reduce the distance A between the electrodes 2, 3 in the direction of the transverse axis Q. In particular, the electrodes 2, 3 have a minimum distance A in the region of the convexities 11.

A thickness or extent of the respective convexity 11 along the transverse axis Q preferably corresponds to a depth of the respective recess 7. The two electrodes 2, 3 each exhibit a thickness or extent along the transverse axis Q. The respective electrode 2, 3 thus exhibits the same thickness along the complete lengthwise extent of the respective electrode 2, 3. In other words, a recess 7 or convexity 11 as described above does not affect the thickness of the respective electrode 2, 3. Rather, the recess 7 and convexity 11 affect the distance between the electrodes 2, 3 and the transverse extent of the cavity 10. In this way, the arc burning region and arc ignition region of the arrester 1 may be separated from one another spatially as described below.

The arrester 1 has an arc ignition region 8. The arc ignition region 8 is that region in which the arc is ignited for electrical discharge between the electrodes 2, 3. The arc ignition region 8 constitutes a first active region of the arrester 1. The arc ignition region 8 is arranged in the region of the minimum distance A between the electrodes 2, 3. Consequently, the arc ignition region 8 is arranged in the region of the convexities 11. The minimum distance A between the electrodes 2, 3 simplifies ignition of the arc.

The arc ignition region 8 is formed in a lateral region of the cavity 10. The arc ignition region 8 is arranged closer to the ceramic body 5 than the arc burning region 9 described below.

The arrester 1 additionally has the above-mentioned arc burning region 9 or second active region for enabling electrical discharge between the electrodes 2, 3 in the event of an overvoltage. In the event of an overvoltage, a discharge, in particular an arc discharge, is thus intended to take place in the arc burning region 9 between the electrodes 2, 3 for electrical discharge. Arc ignition region 8 and arc burning region 9 are separated from one another spatially. The arc burning region 9 is arranged in particular in the region of the maximum distance A between the electrodes 2, 3. Consequently, the arc burning region 9 is arranged in the region of the recesses 7.

The arc burning region 9 is formed in a central region of the cavity 10 or of the arrester 1. The spacing from the ceramic body 5 is in particular at its maximum in the arc burning region 9.

An activation material 6, for example silicates and/or halides of alkali metals, is arranged in the arc burning region 9. The region in which the arc burns is laid down by the activation material 6. The activation material 6 is formed for example in a sub-region of a surface of the respective electrode 2, 3.

As a result of the special shaping of the electrodes 2, 3, the arc burning region 9 and arc ignition region 8 are simply separable from one another. Furthermore, large-area vapor deposition of electrode material on the ceramic body 5 may be prevented. In this way, high insulation resistance is ensured after loading.

The functionality of the arrester 1 may here be described by the ratio (D2/D1)·A, wherein D1 denotes the diameter of the respective recess 7, D2 the internal diameter of the respective electrode 2, 3 and A the distance between the electrodes 2, 3. Preferably, the following applies: $0.7 \leq (D2/D1) \cdot A \leq 1.3$. Particularly preferably, the following applies: $(D2/D1) \cdot A = 1.1$.

FIG. 2 shows a three-electrode arrester 1 for protection against overvoltages. In contrast to the two-electrode arrester 1 of FIG. 2, the arrester 1 depicted in FIG. 3 has a third electrode or center electrode 4.

The third electrode 4 is arranged between the first and second electrodes 2, 3. Unlike the first and second electrodes 2, 3, the third electrode does not have a curved shape. Instead, the third electrode 4 is configured to be straight or along the longitudinal axis L. The third electrode 4 has a planar surface. The third electrode 4 has neither a recess 7 nor a convexity 11.

The shape of the first and second electrodes 2, 3 corresponds, on the other hand, to the shape described in relation to FIG. 1. In particular, all the structural and functional features described in relation to FIG. 1 also apply to the arrester 1 of FIG. 2 unless otherwise described below. Thus, only the differences from the arrester of FIG. 1 will be described below.

The third electrode 4 has a central cut-out 13 (opening). The cut-out 13 passes right through the third electrode 4. The cut-out 13 is arranged opposite the recesses 7 of the first and second electrodes 2, 3. The cut-out 13 serves to connect the gas-filled cavity 10 between the first electrode 2 and the third electrode 4 with the gas-filled cavity 10 between the second electrode 3 and the third electrode 4. The intention is that, in the event of an overvoltage, both portions of the three-electrode arrester 1 are thereby ignited.

The third electrode 4 passes through the ceramic body 5. In other words, the ceramic body 5 is arranged around the third electrode 4. The electrodes 2, 3 and 4 are separated electrically and spatially from one another by the ceramic body 5.

The electrodes 2, 3 and 4 exhibit a minimum distance A from one another. In particular, the distance A is at its minimum in that region in which the convexities 11 of the first and second electrodes 2, 3 are arranged. In other words, in the region of the convexity 11 of the first electrode 2 the first electrode 2 and the third electrode 4 exhibit a minimum distance A from one another. In the region of the convexity 11 of the second electrode 3, the second electrode 3 and the third electrode 4 likewise exhibit a minimum distance A from one another. The arc ignition region 8 is arranged in each case in the region of the minimum distance A.

In the region of the recess 7 of the first electrode 2 the first electrode 2 and the third electrode 4 exhibit a maximum distance A from one another. In the region of the recess 7 of the second electrode 3, the second electrode 3 and the third electrode 4 likewise exhibit a maximum distance A from one another. In the region of the maximum distance A the arc burning region 9 is arranged. This is laid down spatially by the arrangement of the activation material 6. Moreover, the central cut-out 13 of the third electrode 4 is also provided in the region of the maximum distance A.

All further features correspond to the features described in relation to FIG. 1. In particular, the functionality of the arrester 1 is here also described by the ratio (D2/D1)·A, wherein D1 denotes the diameter of the respective recess 7, D2 the internal diameter of the respective electrode 2, 3 and A the distance between the respective electrode 2, 3 and the third electrode 4. Preferably, the following also applies here: $0.7 \leq (D2/D1) \cdot A \leq 1.3$. Particularly preferably, the following applies: $(D2/D1) \cdot A = 1.1$.

The invention is not restricted by the description given with reference to the exemplary embodiments. Rather, the invention encompasses any novel feature and any combination of features, including in particular any combination of features in the claims, even if this feature or this combination is not itself explicitly indicated in the claims or exemplary embodiments.

The invention claimed is:

1. An arrester comprising:

at least one first and one second electrode;

a ceramic body for electrical isolation of the first and second electrodes, wherein the first and second electrodes are spaced by a distance from one another in a direction of a transverse axis of the arrester, wherein the distance between the first and second electrodes varies along a longitudinal axis of the arrester, wherein each of the first and second electrodes has a central recess, and wherein the central recesses are formed mutually opposite around the longitudinal axis of the arrester; and a third electrode arranged between the first and second electrodes, wherein the third electrode does not have a recess.

2. The arrester according to claim 1, wherein the distance between the first and second electrodes is at its maximum in a region of the central recesses.

3. The arrester according to claim 1, wherein the first and second electrodes and/or the first and third electrodes and/or the second and third electrode exhibit a minimum distance from one another in a direction of the transverse axis of the arrester.

4. The arrester according to claim 3, wherein at least one arc ignition region is arranged in a region of the minimum distance.

5. The arrester according to claim 3, wherein each of the first electrode and the second electrode has at least one convexity, and wherein the minimum distance between the first and second electrodes is formed in a region of the convexity.

6. The arrester according to claim 1, wherein each central recess has a diameter, wherein each of the first and second electrodes has an internal diameter, wherein $0.7 \leq (D2/D1) \cdot A \leq 1.3$, and wherein A is a minimum distance between the third electrode and the first and second electrodes, D1 is the diameter of the central recess and D2 is the internal diameter.

7. The arrester according to claim 1, wherein the first and second electrodes and the ceramic body enclose a cavity filled with a noble gas, and wherein the arrester is a gas discharge surge arrester.

8. The arrester according to claim 1, wherein the arrester has at least one arc ignition region and at least one arc burning region, and wherein the arc ignition region and the arc burning region are separated spatially from one another.

9. The arrester according to claim 8, wherein the arc burning region is arranged in a region between central recesses.

10. The arrester according to claim 8, further comprising an activation material arranged in the arc burning region.

11. An arrester comprising:

at least one first electrode and one second electrode;

a ceramic body for electrical isolation of the first and second electrodes, wherein the first and second electrodes are spaced by a distance from one another in a direction of a transverse axis of the arrester, wherein the distance between the first and second electrodes varies along a longitudinal axis of the arrester, wherein each electrode has a central recess, and wherein the central recesses of the electrodes are formed mutually opposite around the longitudinal axis of the arrester; and a third electrode arranged between the first and second electrodes, wherein the third electrode does not have a recess, wherein each central recess has a diameter, wherein each of the first and second electrodes has an internal diameter, wherein $0.7 \leq (D2/D1) \cdot A \leq 1.3$, and wherein A is a minimum distance between the third electrode and the first and second electrodes, D1 is the diameter of the central recess and D2 is the internal diameter.

12. The arrester according to claim 11, wherein the distance between the first and second electrodes is at its maximum in a region of the central recesses.

13. The arrester according to claim 11, wherein the first and second electrodes and/or the first and third electrodes and/or the second and third electrode exhibit a minimum distance from one another in a direction of the transverse axis of the arrester.

14. The arrester according to claim 13, wherein at least one arc ignition region is arranged in a region of the minimum distance.

15. The arrester according to claim 13, wherein each of the first electrode and the second electrode has at least one convexity, and wherein the minimum distance between the first and second electrodes is formed in a region of the convexity.

16. The arrester according to claim 11, wherein the first and second electrodes and the ceramic body enclose a cavity filled with a noble gas, and wherein the arrester is a gas discharge surge arrester.

17. The arrester according to claim 11, wherein the arrester has at least one arc ignition region and at least one arc burning region, and wherein the arc ignition region and the arc burning region are separated spatially from one another.

18. The arrester according to claim 17, wherein the arc burning region is arranged in a region between central recesses.

19. The arrester according to claim 17, further comprising an activation material arranged in the arc burning region.

* * * * *